US010244875B1

(12) United States Patent
Lydon

(10) Patent No.: US 10,244,875 B1
(45) Date of Patent: Apr. 2, 2019

(54) ADJUSTABLE MEDIA FRAME

(71) Applicant: Sean Lydon, Methuen, MA (US)

(72) Inventor: Sean Lydon, Methuen, MA (US)

(73) Assignee: Sean Lydon, Methuen, MA (US)

( * ) Notice: Subject to any disclaimer, the term of this patent is extended or adjusted under 35 U.S.C. 154(b) by 0 days.

(21) Appl. No.: 15/921,606

(22) Filed: Mar. 14, 2018

(51) Int. Cl.
*A47G 1/08* (2006.01)
*A47G 1/06* (2006.01)

(52) U.S. Cl.
CPC ..... *A47G 1/08* (2013.01); *A47G 2001/0672* (2013.01)

(58) Field of Classification Search
CPC ..... A47G 1/08; A47G 2001/0672
See application file for complete search history.

(56) References Cited

U.S. PATENT DOCUMENTS 1,091,623 A * 3/1914 Bland ..... A47G 1/08 40/741
1,308,695 A * 7/1919 Bushkovski ..... A47G 1/08 40/741
2,854,774 A * 10/1958 Horwitt ..... A47G 1/08 40/739
2,866,286 A * 12/1958 Hartman ..... A47G 1/08 40/741
2,877,585 A * 3/1959 Horwitt ..... A47G 1/08 248/490
3,465,461 A * 9/1969 Price ..... A47G 1/08 40/209
4,277,903 A * 7/1981 Crossot ..... A47G 1/1606 40/757
4,356,647 A * 11/1982 Farris ..... G09F 15/02 40/661
4,459,773 A * 7/1984 Sandlin ..... G09F 15/02 40/603
4,959,916 A * 10/1990 Cochrane ..... A47G 1/08 40/603
4,993,177 A * 2/1991 Hudson ..... A47G 1/0616 40/593
6,688,029 B1 * 2/2004 Dunn ..... A47G 1/06 40/711
7,086,190 B2 * 8/2006 Voluckas ..... G09F 7/20 248/331
7,296,373 B1 * 11/2007 Hahn ..... G09F 1/12 40/617
2016/0360903 A1 * 12/2016 Knowlden ..... A47G 1/06

* cited by examiner

*Primary Examiner* — Gary C Hoge
(74) *Attorney, Agent, or Firm* — Malone IP Law; Steven J. Malone

(57) ABSTRACT

An adjustable media frame has been developed. The adjustable media frame includes an adjustable upper rail and a hanging pendant member. The adjustable upper rail includes a first upper rail member and a second upper rail member with the first upper rail member sliding in or over the second upper rail member to adjust the length of the upper rail. The hanging pendant member is included with a hanging connection point to both the first upper rail member and the second upper rail member.

20 Claims, 7 Drawing Sheets

ADJUSTABLE MEDIA FRAME

FIELD OF THE INVENTION

The present invention discloses an adjustable media frame with structural features for use with media of varying sizes.

BACKGROUND

Displaying pictures and posters provides the dilemma of presenting such in an aesthetic and protected manner. A picture frame has a severely limited size and involves added weight and bulk as well as an additional cost. The lack of a frame in displaying results in the need to later remove residual adhesive and consequently involves potential damage to the picture, poster, or wall.

SUMMARY

A media frame has been developed, the which consists of an adjustable upper rail and a hanging pendant member. The adjustable upper rail includes a first upper rail member and a second upper rail member with the first upper rail member sliding in or over the second upper rail member to adjust the length of the upper rail. The hanging pendant member is included with a hanging connection point to both the first upper rail member and the second upper rail member.

The media frame may include a lower adjustable rail, identical to the upper rail with the first and second members allowing adjusted length. The lower rail, like the upper rail, may contain hanging connection points for the hanging pendant member. In a cross-cut view the rails may be square or rectangular in shape, allowing a flat surface for attachment of the media material. The rails may be constructed of a variety of materials, including, but not limited to: metal, wood, or plastic.

The method of securing the media material may include magnets to adhere to a magnetic rail, or a rail with a magnet or a magnetic strip attached. The magnets, or other form of fastener, may vary in abundance, strength, size, shape, style, or strength according to weight or size of the media material. Other methods may include one or more of: a cork strip, clips, hooks, fasteners, clamps, pinch rollers, or wire brads attached to the rail or any combination of these. Media material may also be hung over or taped to the rail of the media frame.

Hanging pendant member may be a string, chain, or wire and an appropriate length to be adjusted according to the adjusted width of the frame. It may also be adjusted to a desired distance from hanging point. The length of the hanging pendant member may be adjusted at the hanging connection points. The hanging connection points may also be adjusted along the rail in relation to the ends of the adjustable rail.

Media material may be of any material: fabric, paper, cardboard, or plastic. Visual details may be present on either or both sides of the media material to be displayed. The display of media material may include a number of pieces, such as a collage, or just one piece, such as a banner or poster, and may be displayed horizontally or vertically.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

It will be readily understood that the components of the present invention, as generally described and illustrated in the Figures herein, could be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. The presently described embodiments will be best understood by reference to the drawings.

Figure 1B:
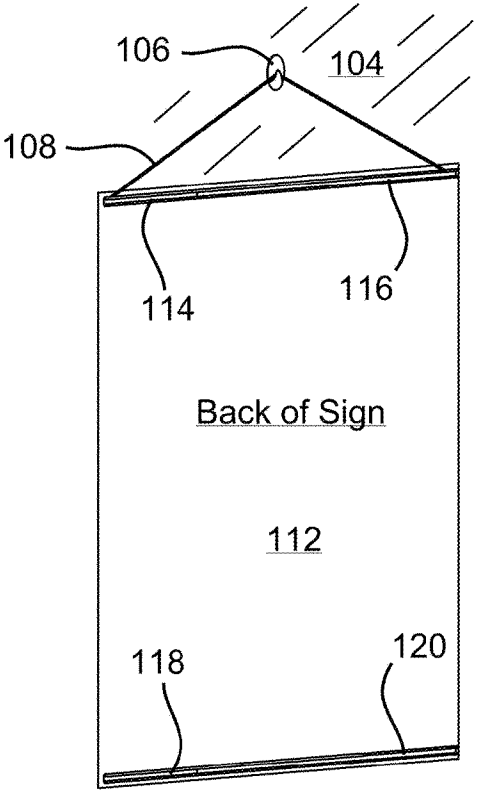
FIG. 1B shows a back view of the invention in use in accordance with an embodiment of the invention.
Figure 1A:
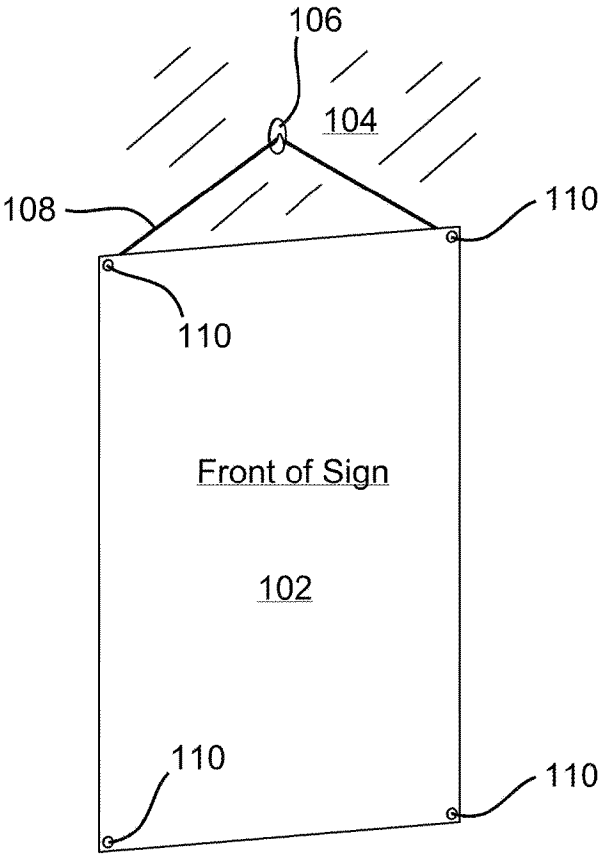
FIG. 1A shows a front view of the invention in use in accordance with an embodiment of the invention.

FIG. 1A shows a front view of the invention 104 in use in accordance with an embodiment of the invention. Display material 102 is displayed by the media frame 104, including the magnets 110 which secure the display material to the frame. Hanging pendant member 108 is adjustably attached to the frame and hangs from a single hook or nail 106 which may be included in a packaged retail version of the invention. Application of the product may include displaying advertisements in a store window. Windows provide an ideal surface to hang one or more rails using a pendant member and a single adhesive hook. Rails may be adjusted to a precise width of media material and an advertisement or media material 102 may be secured to the rails using magnets 110. Rail may be adjusted to different sizes based on media having different widths on a top portion and a bottom portion. Hanging pendant member 108 may be adjusted to appropriate hanging length and hung from a hook 106 applied to window 104 for displaying an advertisement or other media material 102. Hook 106 may be a command strip adhesive hook manufactured by 3M. Other applications may include hook 106 being applied to interior or exterior walls to display posters, banners, flags, advertisements, announcements, or decorations. Another embodiment of the invention may include displaying multiple pieces of media material 102 at once. This may involve securing strings or wires to the rails and attaching a collage of pictures or other media to the strings. Uses may vary from indoor to outdoor use, as well as commercial and private use. An application of the invention may include displaying double-sided media 112 or single sided media 102 to be hung from a window, door, shelf, display, in free-space (dangling), or ceiling.

FIG. 1B shows a back view of the invention 104 in use in accordance with an embodiment of the invention. Media frame includes first upper rail member 114 and second upper rail member 116 the two of which slide together or apart in an adjustable manner as needed to display media. The first upper rail member 114 and the second upper rail member 116 have an adjustable connection to the hanging pendant member 108. The frame may also include a lower rail with a first lower rail member 118 and a second lower rail member 120 that slide together and apart in order to be adjustable. An application of the invention may include displaying double-sided media 112 or single sided media 102 to be hung from a window, door, shelf, display, in free-space (dangling), or ceiling. Windows provide an ideal surface to hang one or more rails using a pendant member and a single adhesive hook.

Figure 2:
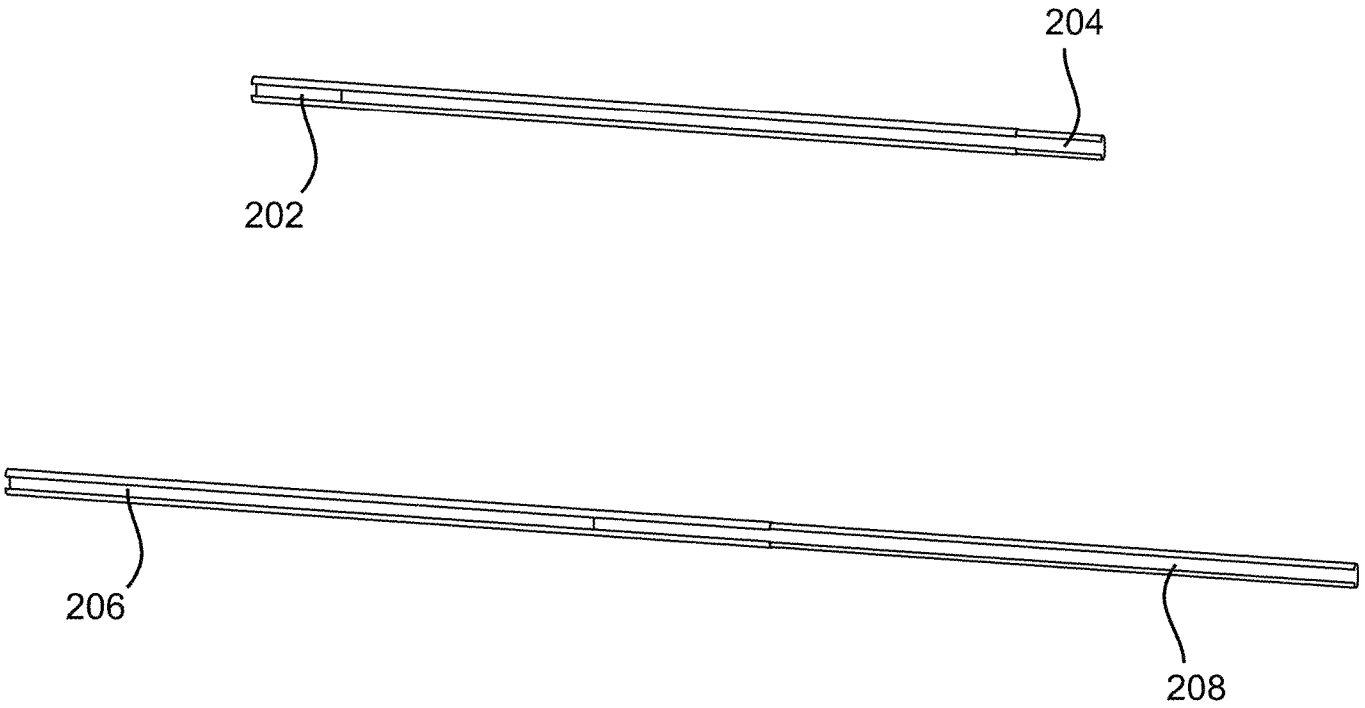
FIG. 2 shows the upper and lower rails in the ability to adjust in accordance with an embodiment of the invention.

FIG. 2 shows the upper and lower rails in the ability to adjust in accordance with an embodiment of the invention. The first upper rail member 202 fits over or around the second upper rail member 204, allowing the two pieces to slide together as depicted. The first lower rail member 206 fits similarly over the second lower rail member 208 to allow the pieces to slide apart in the same manner, as depicted. Variations may be present in that the rails may be fully enclosed as tubes or in a variety of cross-cut shapes.

Figure 3A:
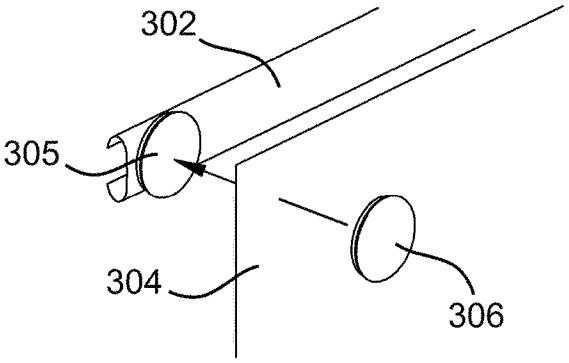
FIG. 3A shows the adjustable rail constructed of a magnetic material in accordance with an embodiment of the invention.

FIG. 3A shows the adjustable rail constructed of a magnetic material 305 in accordance with an embodiment of the invention. The depicted adjustable rail 302 may be constructed of ferrous material, allowing the media material 304 to be secured to the adjustable rail 302 and frame by being pinned and held by the strength of magnets 305 and 306. The media material 304 could likewise be pinched or held to the adjustable rail 302 using clips or other securing methods. One magnet 306 may be used with or without a corresponding magnet 305. Magnet 305 may be glued or mounted to rail 302 using fasteners. In the case of a plastic rail 302, two magnets 305 and 306 may be needed to secure media material 304. Magnet 305 may be glued or fastened to plastic rail 302.

Figure 3B:
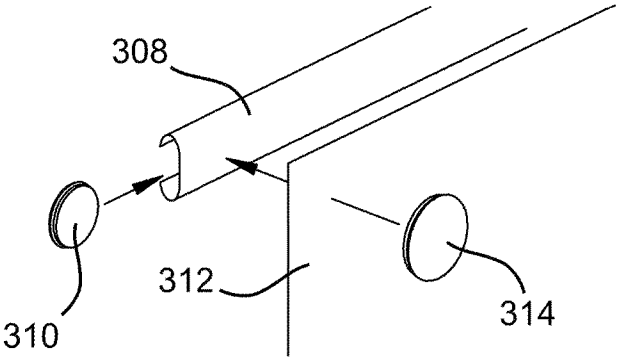
FIG. 3B shows a non-magnetic adjustable rail with a slot to hold an additional magnet in accordance with an embodiment of the invention.

FIG. 3B shows a non-magnetic adjustable rail 308 with a slot to hold an additional magnet 310 in accordance with an embodiment of the invention. The adjustable rail 308 allows a slot for a second magnet 310 to be inserted or attached in order to better hold the media material 312 with the magnet 314. Magnet 310 may be glued or fastened to rail 308. Rail 308 may be made of ferrous or non-ferrous materials. Media material 312 may also be secured directly to rail 308 by use of brackets, sliding clamps, pinch rollers, or other forms that do not require additional pieces such as pins or magnets.

Figure 3C:
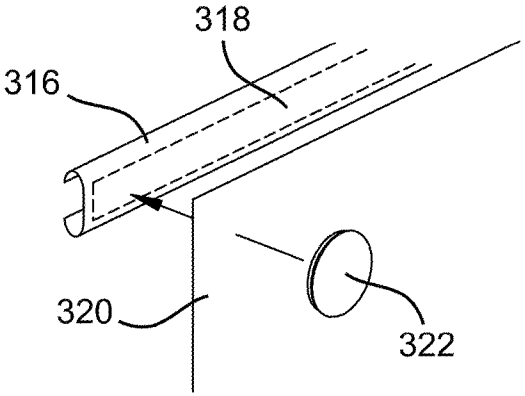
FIG. 3C shows an adjustable rail with an attached magnetic strip in accordance with an embodiment of the invention.

FIG. 3C shows an adjustable rail 316 with an attached magnetic strip 318 in accordance with an embodiment of the invention. The adjustable rail 316, which may not be magnetic may include an attached magnetic strip 318 for a magnet 322 to adhere to through the media material 320. The strip 318 attached to the adjustable rail 316 may also be constructed of cork or another material that allows the media material 320 to be secured to the adjustable rail 316. Media material 320 may be secured to cork strip 318 by pushpin 322. Media material 320 may include one or more piece and may be a collage of pictures secured to rail 316 individually. Rail 316 may be made of: plastic, metal, carbon fiber, an elastomeric compound, a petroleum product, or a combination thereof.

Figure 4:
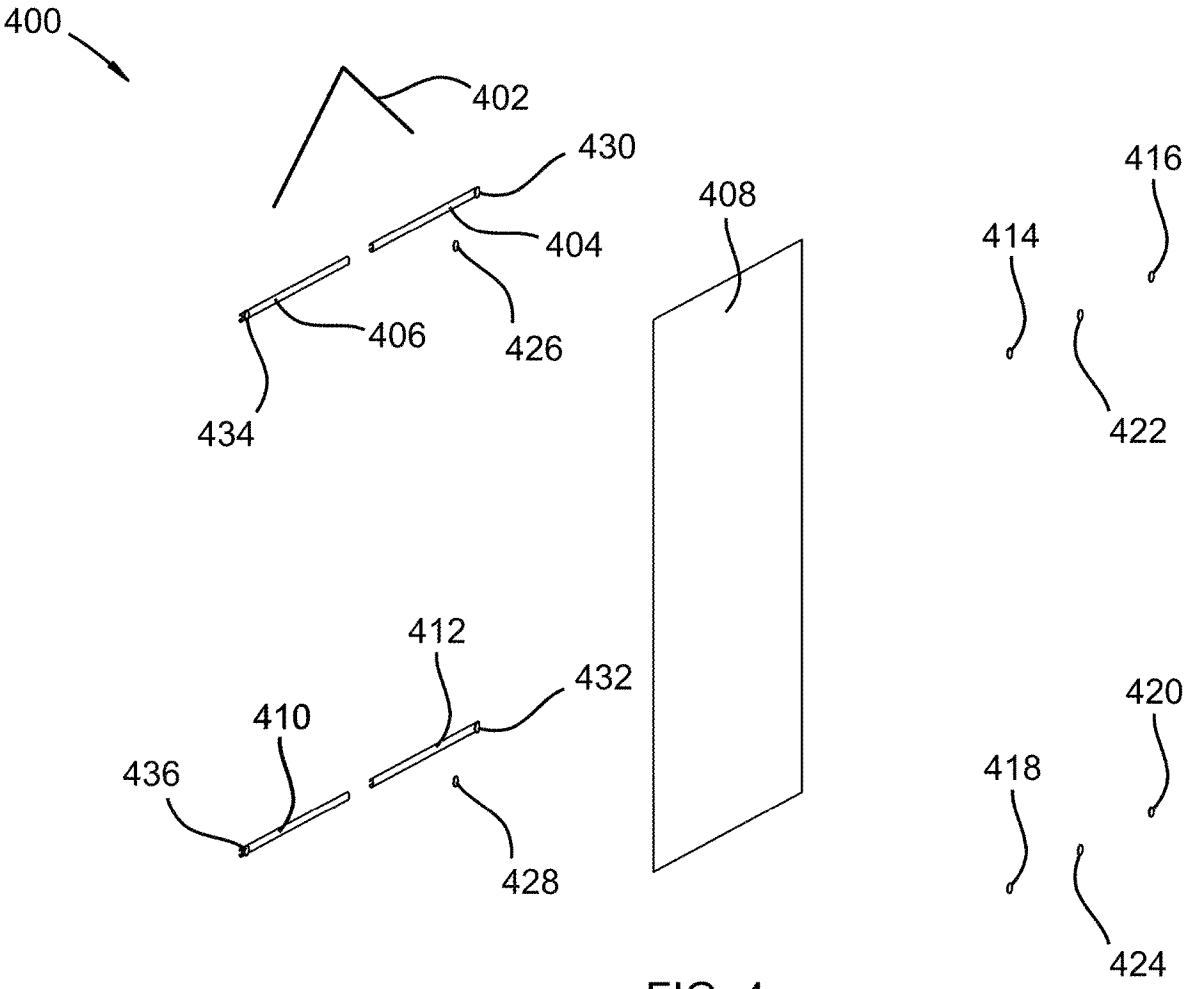
FIG. 4 shows an exploded view of the complete invention in use in accordance with an embodiment of the invention.

FIG. 4 shows an exploded view of media frame 400 in accordance with an embodiment of the invention. The device includes a first upper rail 406 and the second upper rail 404 to form an adjustable rail to the hanging pendant member 402. Among the variable methods, magnets 414 and 416 may be used to secure the media material 408 to the media frame 406 and 404. Magnets 434 and 430 may be attached to rails 406 and 404 by glue, fastener, or by magnetic attraction to iron. Medial material 408 may be secured between magnets 434 and 414 on one end and between magnets 430 and 416 on the other end of the upper rail. Medial material 408 may be secured between magnets 436 and 418 on one end and between magnets 432 and 420 on the other end of the lower rail. Magnets 428 and 426, in some embodiments, may not be attached to the upper rail or lower rail except by magnetism. Removable magnets 426 and 424 allow the upper rails and lower rails to be adjusted while maintaining a centered magnet position when media of differing sizes are used with media frame 400. The first lower rail 410 and the second lower rail 412 may be used in addition with magnets 418 and 420 to secure and straighten the media material 408. Media material 408 may be an array of strings or wires to which a collage of pictures may be attached. Lower rail members 410 and 412 may include connection to a second hanging pendant member 402 and may be used to display media material 408 horizontally with upper rail members 406 and 404 similarly in use with hanging pendant member 402.

Figure 5A:
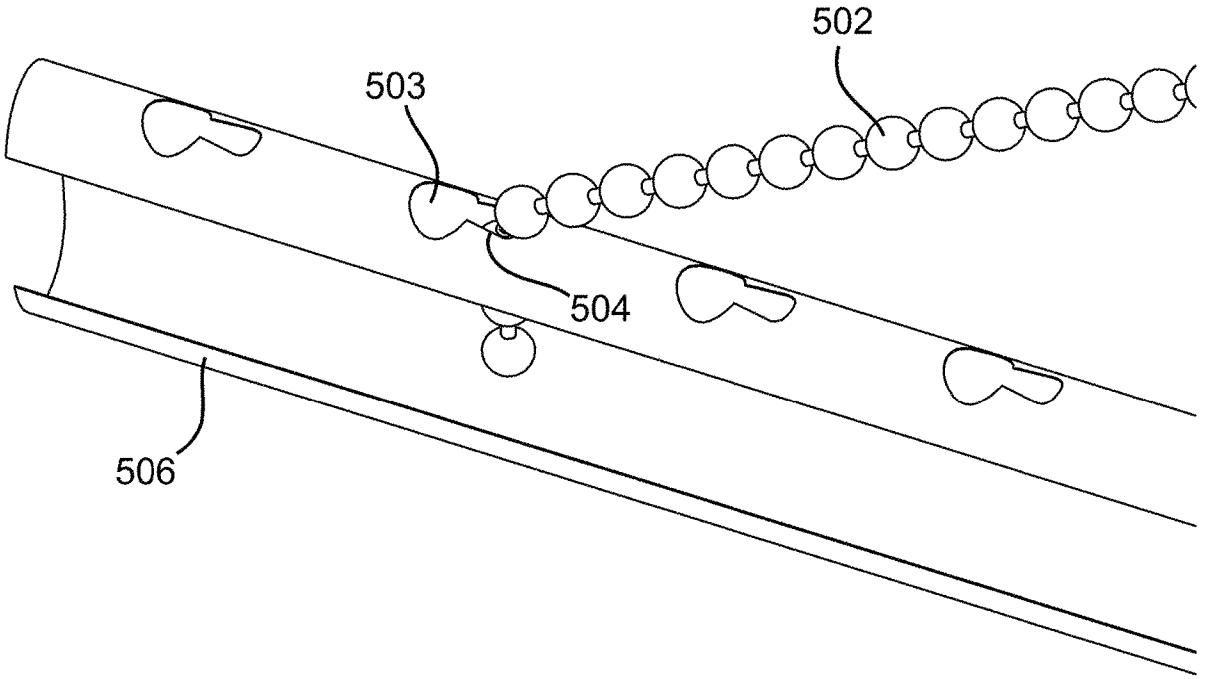
FIG. 5A shows adjustable hanging connections in accordance with an embodiment of the invention.
Figure 5B:
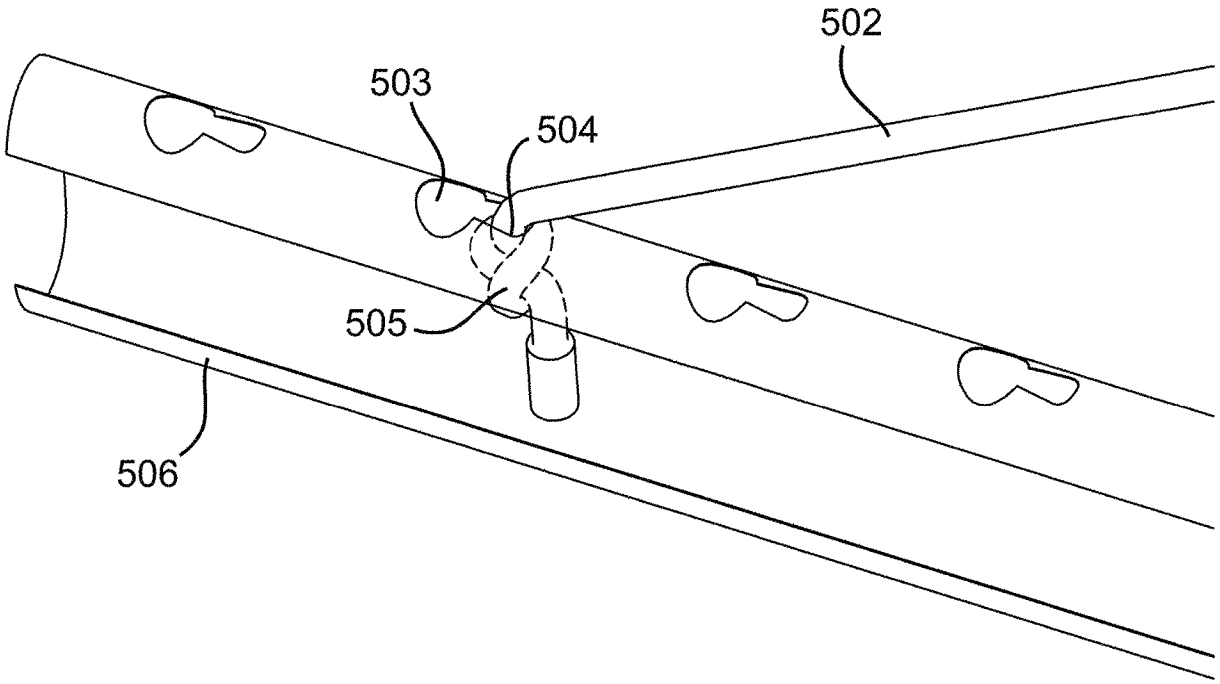
FIG. 5B shows adjustable hanging connections in accordance with an embodiment of the invention.

FIGS. 5A and 5B show the adjustable hanging connections in accordance with an embodiment of the invention. Located on the adjustable rail 506 is a hanging connection 504. The hanging connection 504 may be adjusted by fitting into a desired connection slot 503. Hanging pendant member 502 is also adjustable at hanging pendant member adjusting point 505. Hanging connection point 504 may be a spring-loaded device or clip that secures itself to the inside of rail 506 and is easily adjusted. Hanging pendant member adjusting point 505 may be a use of knots as well as a method of interlocking segments with the hanging connection point 504. Hanging connection point 504 may vary in design including an open or closed design as well as interlocking or pinch-gripping method to connect with hanging pendant member 502. Slot 503 may, in some embodiments, be a circular through hole. An end of pendant member 502 may be dropped through a circular hole 503 and a clamp or crimp device may be locked on to an end or portion of pendant member 502. A knot may also be tied in pendant member 502 to secure a portion of pendant member 502 behind hole 503 in rail 506.

Figure 6:
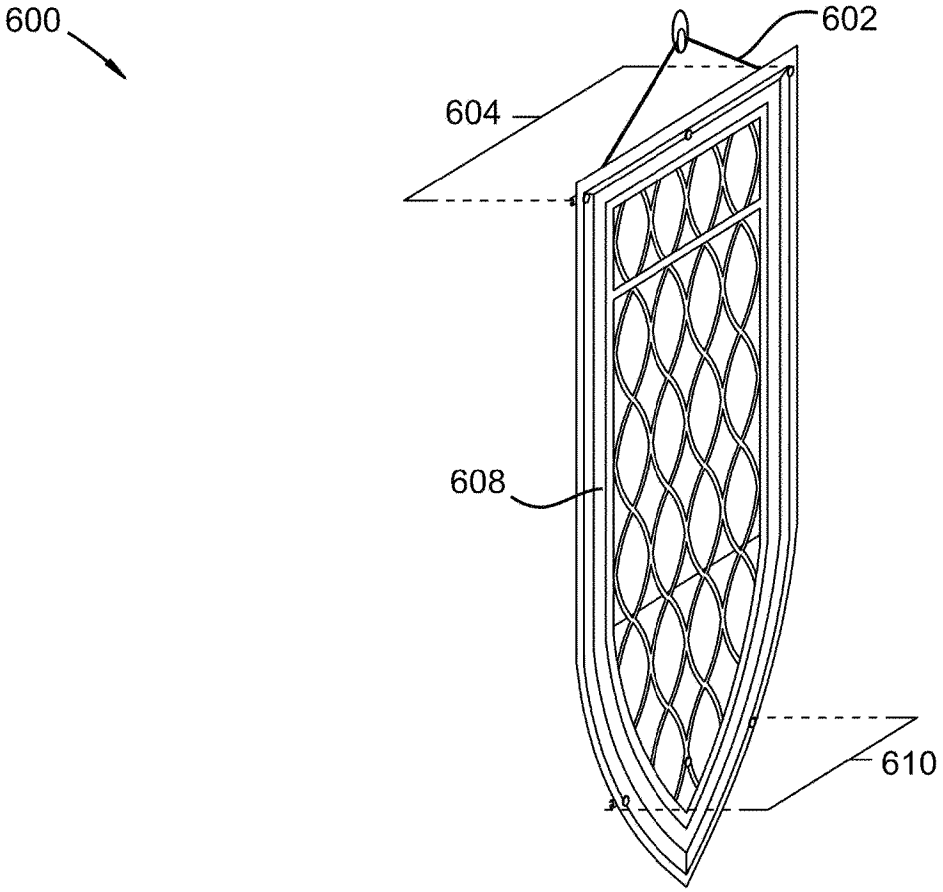
FIG. 6 shows an adjustable media frame in accordance with an embodiment of the invention.

FIG. 6 shows an adjustable media frame 600 including media material 608. Media material 608 is wider at the top 604 than at the bottom 610. Media frame 600 may be hidden behind media 608 and extend to a precise width 604/610 of medial material 608. Lower rail 610 provides needed support and weight to keep media material 608 flat and straight. Media material 608 may be ridged material, thin material, paper, plastic, cardboard, faux window material, faux siding material, screen material, or any other material that could be hung from a pendant frame.

The systems and methods disclosed herein may be embodied in other specific forms without departing from their spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A media frame comprising:

an adjustable upper rail;

wherein the adjustable upper rail includes a first upper rail member and a second upper rail member;

wherein the first upper rail member slides in or over the second upper rail member to adjust the upper rail;

a center media fastener that is removable and repositionable along the adjustable upper rail;

a hanging pendant member; and wherein the first upper rail member and the second upper rail member each contain at least one hanging connection point connecting the hanging pendant member to the adjustable upper rail of the media frame.

2. The media frame of claim 1, further comprising an adjustable lower rail substantially parallel to the adjustable upper rail.

3. The media frame of claim 2, wherein the adjustable lower rail is adjustable in a direction which is parallel to an adjustable direction of the adjustable upper rail.

4. The media frame of claim 2, wherein the adjustable lower rail further comprises a first lower rail member and a second lower rail member.

5. The media frame of claim 4, wherein the first lower rail member slides in or over the second lower rail member to adjust the lower rail.

6. The media frame of claim 2, wherein the media frame is of a customizable size or dimension such that media material with differing sizes of top portions and bottom portions match an exact width of the upper rail and the lower rail when the media material is attached to the media frame.

7. The media frame of claim 2, wherein media material of the media frame physically connects the upper rail to the lower rail.

8. The media frame of claim 2, wherein the first lower rail member and the second lower rail member each adjust to an exact width of media material which connects the upper rail to the lower rail.

9. The media frame of claim 1, wherein the center media fastener is at least one magnet removeably attachable by magnetism to the adjustable upper rail.

10. The media frame of claim 1, wherein the hanging pendant member is constructed of string, wire, or chain.

11. The media frame of claim 10, wherein the hanging pendant member is adjustable at the hanging connection points.

12. The media frame of claim 11, wherein the hanging connection points are adjustable in relation to the ends of the adjustable rail.

13. The media frame of claim 1, wherein the upper rail further comprises a track.

14. The media frame of claim 1, wherein the upper rail is least partially constructed of a ferrous material.

15. The media frame of claim 14, wherein the ferrous material is a magnet or magnetic strip attached to the upper rail.

16. The media frame of claim 15, wherein media material is attached to the upper rail by at least two or more magnets.

17. The media frame of claim 16, wherein the two or more magnets are configured to properly secure the media material to the media frame.

18. The media frame of claim 1, wherein the upper rail further comprises one or more of: a cork strip, hooks, fasteners, clamps, pinch rollers, or wire brads.

19. The media frame of claim 1, further comprising clips attached to either end of the upper rail.

20. The media frame of claim 1, wherein the media frame is of a customizable size or dimension such that media material of differing sizes matches an exact width of the medial frame.

* * * * *